US005738779A

United States Patent [19]

Dach et al.

[11] Patent Number: 5,738,779

[45] Date of Patent: Apr. 14, 1998

[54] HYDROTREATING PROCESS WITH TWO PHASE FLOW SPLITTING AND HEAT RECOVERY

[75] Inventors: Michael Markel Dach; Rich Walter Barkley; Jon Andrew Branson, all of Houston; James Raymond Stoy, Missouri City, all of Tex.; James Lindsey Gilbert Schrodt, Bakersfield, Calif.

[73] Assignee: Texaco Inc., White Plains, N.Y.

[21] Appl. No.: 709,559

[22] Filed: Jul. 18, 1996

[51] Int. Cl.[6] ..... C10G 45/00

[52] U.S. Cl. ..... 208/143; 208/144; 208/213; 208/251 H; 208/254 H; 208/95; 585/264; 585/910

[58] Field of Search ..... 208/143, 144, 208/213, 251 H, 254 H, 95; 585/264, 910

[56] References Cited

U.S. PATENT DOCUMENTS

| | | | |
|---|---|---|---|
| 4,516,986 | 5/1985 | Jepson | 55/18 |
| 4,522,218 | 6/1985 | Konak | 137/3 |
| 4,574,837 | 3/1986 | Aggour et al. | 137/561 A |
| 4,983,279 | 1/1991 | Klein et al. | 208/413 |
| 5,218,985 | 6/1993 | Berger et al. | 137/8 |
| 5,250,104 | 10/1993 | Berger et al. | 95/254 |

*Primary Examiner*—Walter D. Griffin
*Assistant Examiner*—Nadine Preisch
*Attorney, Agent, or Firm*—Henry H. Gibson; Carl G. Ries

[57] ABSTRACT

In a hydrotreating process a two phase flow splitter is used in combination with parallel heat exchanger trains for heat transfer stability. Flow maldistribution of liquid and vapor between heat exchanger trains is thereby avoided without more complex feedback control. The two phase flow splitter is inherently phase volume ratio stable. Prior methods of flow splitting were only phase volume ratio metastable. Improved heat recovery at lower equipment cost is thereby achieved.

8 Claims, 1 Drawing Sheet

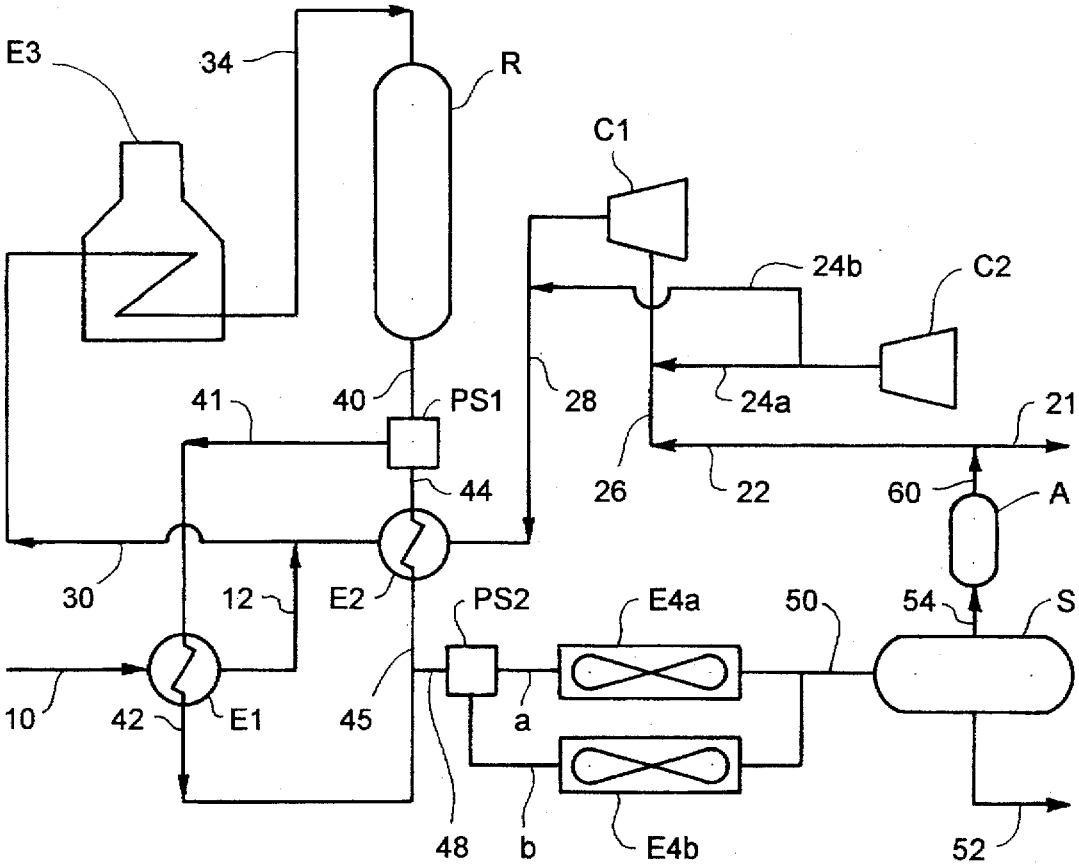
E3
34
R
C1
24b
C2
41
40
PS1
28
24a
21
26
22
60
A
44
30
12
E2
PS2
E4a
50
54
S
10
42
E1
45
a
48
b
E4b
52

HYDROTREATING PROCESS WITH TWO PHASE FLOW SPLITTING AND HEAT RECOVERY

BACKGROUND OF THE INVENTION

1. Field of the Invention

The invention relates to heat integration of a catalytic hydrogenation process. More particularly the invention relates to optimizing heat recovery by providing stable mixed phase flow through heat exchange apparatus. Most particularly the invention relates to dividing a mixed phase reactor effluent into portions having the same liquid/vapor volume ratio and recovering heat therefrom.

2. Description of Other Related Methods in the Field

Hydrotreaters are employed in petroleum refineries to hydrogenate petroleum derived stocks. Hydrogenation removes sulfur, nitrogen, metals and other undesirable contaminants from the stock. Hydrogenation also saturates olefinic and aromatic compounds rendering the stock more stable to thermal degradation as well as stabilizing color.

Hydrotreating is typically carried out in a packed bed of catalyst. Hydrotreating catalysts typically comprise a Group IV metal or a Group VI metal on a porous solid support. The most typical metals are nickel, Raney nickel, cobalt and molybdenum. Cobalt-molybdenum and nickel-molybdenum on an alumina support are in wide commercial use in the petroleum refining industry for this purpose. The hydrogenation reaction is carried out at a hydrogen partial pressure of 100 to 200 psia and a temperature of 400° F. to 850° F.

A hydrotreater apparatus includes: a charge pump, hydrocarbon oil/effluent and hydrogen/effluent heat exchangers, a charge heater, one or more reactor vessels, a product separator, recycle gas treater, a recycle hydrogen compressor and a make-up hydrogen compressor.

The hydrocarbon oil/effluent and hydrogen/effluent exchangers are used to preheat the reactants. The charge heater supplies the remaining heat to bring the feed to reactor inlet temperature. The reactor effluent is cooled several hundred degrees before reaching the product separators. Heat is recovered by heat exchange with the reactants. Hydrogen and oil may be mixed either upstream or downstream of the feed/effluent exchangers. Mixing upstream of the exchangers provides greater temperature differentials, higher heat transfer coefficients and reduced fouling. This is typical of a feed which is fully vaporized in the exchangers. However, when a mixed phase is fed to the reactors and/or charge heaters this can be a problem except for small units with a single pass heater, i.e. less than 5000 barrels per day. In all but the small units the mixed hydrogen and oil must be fed to a parallel pass heater. To avoid maldistribution in the multiple passes there must be a flow rate sensor and flow rate control valve on each pass for each phase. Two-phase mixtures are difficult to measure and flow control. The hydrogen and oil must be passed through separate heat exchanger trains upstream of the respective flow control loops.

SUMMARY OF THE INVENTION

The invention is a hydrotreating process for catalytically hydrogenating a hydrocarbon liquid.

The hydrocarbon liquid is preheated in a first indirect heat exchange means to produce a preheated hydrocarbon liquid. A hydrogen containing vapor is preheated in a second indirect heat exchange means to produce a preheated hydrogen containing vapor. The preheated hydrocarbon liquid and preheated hydrogen containing vapor are mixed and heated to a reactor inlet temperature in a third indirect heat exchange means to produce a mixed phase hydrocarbon mixture.

The mixed phase hydrocarbon mixture is passed to a reactor vessel containing hydrogenation catalyst. Hydrogenation releases heat to produce a mixed phase reactor effluent at a reactor outlet temperature.

The mixed phase reactor effluent is divided into a major portion and a minor portion. Dividing is by means of a two phase flow splitter and as a result, both the major and minor portions comprise about the same liquid/vapor volume ratio.

The major portion is passed to the first indirect heat exchange means and cooled by indirect heat exchange with the hydrocarbon liquid. The minor portion is passed to the second indirect heat exchange means and cooled by indirect heat exchange with the hydrogen containing vapor.

As a result of the major and minor portions comprising about the same liquid/vapor volume ratio, stable phase distribution between first and second heat exchange means is maintained, thereby providing stable and predictable heat recovery.

The invention can be retrofited to an existing hydrotreating process to improve heat recovery and/or cooling. The invention is particularly useful in heat integration by means of heat exchangers in parallel and/or unsymmetrical piping which may be an artifact of a retrofit.

BRIEF DESCRIPTION OF THE DRAWING

The DRAWING is a simplified process flow diagram of a hydrotreating process.

DETAILED DESCRIPTION OF THE DRAWING

Reference is made to the DRAWING. A hydrocarbon feedstock such as a mixture of straight run diesel and cracked hydrocarbon feedstock, e.g. a distillate fraction from fluid catalytic cracking, is passed from a charge pump (not shown) via line 10 under flow control, preheated on the shell side of heat exchanger E1 to form preheated hydrocarbon liquid in line 12. From line 12 it is passed to line 30.

A recycle hydrogen containing gas in line 22 is enriched with hydrogen from make-up hydrogen compressor C2, via line 24*a* and passed to inlet line 26 of recycle compressor C1. In recycle compressor C1, the hydrogen containing recycle gas is compressed and discharged via line 28 to heat exchanger E2. If recycle compressor C1 is not operating, the compressed gas is enriched with hydrogen from make-up hydrogen compressor C2 via line 24*b*, rather than via line 24*a*. In heat exchanger E2 it is preheated on the shell side and is passed to line 30 as a preheated hydrogen containing gas. In line 30 the preheated hydrogen containing gas is mixed with preheated hydrocarbon liquid to form a preheated liquid/vapor mixture which is passed to fired furnace E3.

In fired furnace E3 the temperature of the liquid/vapor mixture is raised to a reactor inlet temperature of about 400° F. to 850° F., typically 600° F. to 700° F. by indirect heat exchange. The heated liquid/vapor mixture is passed at this temperature via line 34 to reactor vessel R. Reactor vessel R contains one or a number of fixed beds, e.g. 3 beds of alumina supported nickel-molybdenum or cobalt-molybdenum hydrogenation catalyst. Reactor pressure is 100 to 2000 psia, typically 500 to 1800 psia. these conditions the hydrocarbon liquid is hydrogenated.

Heat of reaction produces a temperature increase across the reactor bed. Multiple beds and inter-bed cooling are provided to limit the temperature increase to 45° F. or less, preferably about 40° F. across the catalyst bed.

Hydrogenated feedstock leaves reactor vessel R via line 40 as a mixed phase reactor effluent comprising hydrocarbon liquid, hydrocarbon vapor, unreacted hydrogen, hydrogen sulfide, ammonia and lesser amounts of other hydrogenation reaction products.

The mixed phase reactor effluent is passed via line 40 to a first two phase flow splitter PS1 wherein it is divided into two unequal amounts, the larger termed the major portion and the smaller termed the minor portion. As a result of the division by the two phase flow splitter, the relative proportion of liquid to vapor is approximately equal in the two portions. The piping arrangement among phase splitter PS1 and heat exchangers E1 and E2 is drawn to indicate unsymmetrical branches. Maintaining the same liquid/vapor ratio in both unsymmetrical branches is essential.

The major portion is withdrawn from first two phase flow splitter PS1 via line 41 and passed to the tube side of heat exchanger E1 where it is cooled by indirect heat exchange with the hydrocarbon feedstock. The cooled major portion is withdrawn from heat exchanger E1 via line 42.

The minor portion is withdrawn from two phase flow splitter PS1 via line 44 and passed to the tube side of heat exchanger E2 where it is cooled by indirect heat exchange with the hydrogen containing vapor from recycle compressor C1. The cooled minor portion is withdrawn from heat exchanger E2 via line 45.

At this point in the process both the major portion and minor portion may be passed directly to high pressure cold separator drum S to separate the major and minor portions into hydrogen containing vapor and hydrotreated hydrocarbon liquid. Such an arrangement is not shown because in industrial practice additional cooling, e.g. by means of air fan coolers is carried out. Major portion from line 42 and minor portion from line 45 are combined in line 48 to produce a second mixed phase reactor effluent.

The second mixed phase reactor effluent is passed to a second two phase flow splitter PS2 to produce a plurality of at least 2 portions. The number of portions in the plurality will depend entirely on economic considerations and the availability of heat exchangers, e.g. air fan coolers. In industrial practice, 2 to 12 air fan coolers in parallel are often used, with a bank of 4 to 8 air fan coolers in parallel being typical. A retrofit to add cooling capacity may result in unsymmetrical parallel piping to the air fan coolers as shown in the Drawing, air fan coolers of different sizes, combinations of air fan coolers and cooling water coolers or partial bypass.

The second mixed phase reactor effluent is passed to a second two phase flow splitter PS2 where it is divided into a plurality of at least 2 portions. The number in the plurality equals the number of heat exchangers in fourth indirect heat exchange means, illustrated here as heat exchangers E4*a* and E4*b*. The number of two phase flow splitters required to effect the division is one less than the number of heat exchangers in the plurality of heat exchangers. Each portion of the plurality of portions is either equal or unequal in amount. The portion amount depends entirely on the size of the individual heat exchanger. Essentially each portion of the plurality comprises about the same liquid/vapor volumetric ratio. Each portion is passed in parallel, shown here as parallel pipes a and b into fourth indirect heat exchangers E4*a* and E4*b* where the portions are cooled by indirect heat exchange with air at ambient temperature. The portions are recombined in line 50. From line 50 the portions are passed to high pressure cold separator drum S.

High pressure cold separator drum S effects a separation by providing residence time to disengage hydrogen from hydrocarbon oil at a pressure of about 320 psia to 1900 psia to yield a hydrotreated hydrocarbon liquid withdrawn via line 52 and hydrogen containing vapor withdrawn via line 54. Hydrogen containing vapor in line 54 is recycled to the process via absorber vessel A, line 60, line 22 and inlet line 26 to recycle compressor C1.

The hydrogen containing vapor in line 54 is then subjected to treating to remove hydrogen sulfide and other acid gases. In the amine scrubbing process the gaseous stream is contacted countercurrently with a lean aqueous solution of alkanol amine in absorber vessel A. The two alkanol amines in wide commercial use for this purpose are monoethanolamine (MEA) and diethanolamine (DEA). Diglycolamine (DGA), Triethanolamine (TEA) and methyldiethanolamine (MDEA) have also been used for this purpose. The lean aqueous alkanol amine absorbs acid gases comprising primarily hydrogen sulfide and lesser amounts of ammonia and hydrogen chloride. The acid rich stream is passed to a stripper vessel, not shown, in which the aqueous amine solution is reactivated by steam stripping acid gases from the aqueous alkanol amine solution.

Theoretically the treating rate for amine scrubbing is an equimolar amount of amine with the acids. For practical considerations, an amount of amine in molar excess of the acids is used. For monoethanolamine, the design treating rate for a 15 vol. % aqueous monoethanolamine solution is 4 lb mole MEA/lb mole acid at 100° F. to 120° F. This treating rate may be adjusted based on the amine selected, design experience and economy. An essentially acid free hydrogen containing vapor, e.g. with 10 to 1000 ppm by weight hydrogen sulfide is withdrawn via line 60 and passed to line 22.

A small portion of the hydrogen containing vapor is withdrawn from line 22 via bleed line 21. The amount is not critical and may be for example 0.2 vol % to 3 vol %. The purpose of bleed line 21 is to circumvent the uninterrupted accumulation of nonacidic gases by total recycle of hydrogen. Methane is the primary example. Other examples of such nonacidic gases are argo, xenon, helium, and nitrogen.

DETAILED DESCRIPTION OF THE INVENTION

In two phase flow, phase maldistribution occurs when the flowing fluid is divided. Maldistribution results in unequal volumetric proportions of liquid and vapor flowing to two or more downstream branches. This volumetric phase maldistribution is referred to as phase ratio shifting.

Hydrotreating of liquid petroleum derived fractions is inherently a two phase process, involving hydrocarbon liquid and hydrogen gas. Division of mixed phase streams is avoidable only in small units with a single pass heater. For all but small units, optimizing heat recovery necessitates the division of mixed liquid/vapor phases into parallel flows. This division results in unequal liquid to vapor volume proportion in downstream branches. The amount of phase ratio shifting is determined by differences in flow path. Some phase ratio shifting occurs even when piping is balanced, i.e. horizontal and symmetrical. Phase ratio shifting is associated with the following processing phenomena:

a) Type of two phase flow regime upstream of each branch (stratified, slug, annular, dispersed).

b) Degree of flow regime stability upstream of each branch (length of horizontal straight pipe between supply header upstream fittings and downstream branch).

c) Resistance of each phase to change flow direction at each branch (greater momentum of liquid phase due to the greater mass).

d) Orientation of branch take off relative to supply header (horizontal, up, and/or down flow).

e) Style of branch take off fitting (impact T-junction, branch T-junction, Y-junction, cross junction).

f) Type of branch discharge fittings (length of full bore straight pipe, elbow, concentric reducer, eccentric reducer).

Phase ratio shifting is a particular problem in hydrotreating because of the large differential in specific gravity between hydrogen and hydrocarbon oil, the large volume of gas compared to volume of liquid, and relative insolubility of hydrogen in hydrocarbon oil. Hydrotreaters comprise reactor effluent/feedstock hydrocarbon liquid and recycle hydrogen heat exchangers. Parallel heat exchangers provide less pressure drop than series heat exchangers. However for parallel heat exchangers, flow of the two phase fluid through the required manifold causes phase maldistribution.

Two phase flow through branched piping is inherently metastable. The flow would be stable if the two phases were separated. This of course would be undesirable for process reasons, particularly for heat transfer. When phase ratio shifting occurs in a manifold, a disproportionate amount of liquid flows to one of the heat exchangers which causes a change in pressure drop. The change in pressure drop exacerbates flow maldistribution. Flow maldistribution results in a reduction in total heat transfer because of the mismatch between the masses on either side of the tube wall.

The process design art has no reliable method of predicting phase ratio shifting in branched piping. Therefore the metastability of phase separation is overcome by process control. Heat recovery is typically controlled by installing a temperature sensor and valve downstream in each branch. Outlet temperature is monitored and adjusted to maintain an equal outlet temperature from each parallel heat exchanger. Outlet temperature differentials between branches is compensated for by automatic feedback control or by hand control.

Inventors have discovered that phase ratio shifting in a hydrotreating process can be overcome by means of a two phase flow splitter. A number of mechanical configurations for the two phase flow splitter are known in the art. In general the various apparatus are mechanically self compensating for changes in liquid/vapor ratio. This is achieved in most apparatus by allowing phase separation followed by recombination. Flow area and resistance to flow are provided for each separated phase such that the phase ratio in the downstream branches is the same as the phase ratio of the source.

Inventors' U.S. Pat. No. 5,415,195 incorporated herein by reference discloses a METHOD AND APPARATUS FOR CONTROLLING PHASE SPLITTING AT BRANCH T PIPE JUNCTIONS. The apparatus provides an equal liquid/vapor volumetric ratio in both downstream branches. Though the branches may be of equal diameter, for purposes of discussion they are termed a major branch and a minor branch. The apparatus functions by accumulating a portion of the liquid phase in a trap at the bottom of the apparatus. A quantity of trapped liquid is aspirated through a bypass conduit and recombined with vapor flowing through the minor branch. The amount of trapped liquid flowing through the bypass is adjusted by constricting flow in the bypass. In practice the constriction is a sharp edged orifice in an orifice plate.

The square root of the pressure drop created by the constriction is directly proportional to the mass flow rate of the vapor. The mass flow rate of liquid flowing through the bypass is also a function of the square root of the pressure drop created by the orifice. Thus the flow rate of liquid entering the minor branch is directly proportional to the vapor flow rate in the minor branch. This is because the flow rate of liquid in the bypass will come to equilibrium at the rate of which the friction pressure drop in the bypass is equal to the pressure drop of the vapor across the orifice. As a result, the apparatus is self compensating for changes in vapor proportion. If required, the proportion of the liquid phase entering each branch can be controlled by varying the orifice diameter or optionally by means of a valve in the bypass.

Two phase flow splitter methods and apparatus which provide a liquid/vapor ratio in downstream branches equal to the liquid/vapor ratio of the source are shown by way of example in U.S. Pat. Nos. 4,574,837; 5,250,104; 5,218,985; 4,516,986 and 4,522,218 all incorporated herein by reference. These apparatus are referred to as two phase flow splitters. The term "two phase" is understood to specifically refer only to one liquid and one vapor phase. This terminology is consistent with the only two phases present in a hydrotreating process. The apparatus is not used to split multiple liquid phases or to separate solids from liquid or vapor.

This invention is shown by way of Example.

EXAMPLE

A hydrotreater has been operating in a petroleum refinery. Reactor feed composition comprises 90 vol % straight run diesel and 10 vol % fluid catalytic cracked light cycle gas oil. Feed rate averaged 232 std. $m^3$/hr (i.e. corrected to 60° F.). With reference to the DRAWING, 84 mole % of reactor effluent has been passed via a 14 inch line to heat exchanger E1 and 16 mole % has been passed via a 6 inch line to heat exchanger E2.

A two phase flow splitter PS1 will be installed as shown in the DRAWING. Four design cases were simulated on computer. Results were as follows:

Case 1—Start of Run, Design
Case 2—Start of Run, Turn Down
Case 3—End of Run, Design
Case 4—End of Run, Turn Down

| | Case 1 | Case 2 | Case 3 | Case 4 |
|---|---|---|---|---|
| Vapor rate, kg/hr | 65,304 | 32,344 | 127,177 | 57,273 |
| Vapor rate, kg-mol/hr | 2,444 | 2,514 | 2,647 | 2,616 |
| Liquid rate, kg/hr | 151,069 | 68,078 | 89,526 | 43,789 |
| Liquid rate, kg-mol/hr | 642 | 288 | 374 | 181 |

-continued

| | Case 1 | Case 2 | Case 3 | Case 4 |
|---|---|---|---|---|
| Liquid/vapor wt. ratio | 2.31 | 2.10 | 0.70 | .76 |
| Temperature, °C. | 335.23 | 282.97 | 382.29 | 330.37 |
| Pressure, kg/cm$^2$ abs. | 32.307 | 32.500 | 32.286 | 32.341 |
| Vapor density, kg/m$^3$ | 16.659 | 8.810 | 28.032 | 13.776 |
| Liquid density, kg/m$^3$ | 644.10 | 687.99 | 607.58 | 656.44 |
| Hot Vapor Flow, m$^3$/sec | 1.0913 | 1.0242 | 1.2587 | 1.1599 |
| Hot liquid flow, m$^3$/sec | 0.0652 | 0.0275 | 0.0409 | 0.0185 |
| Vapor viscosity, cP | 0.012 | 0.014 | 0.010 | 0.012 |
| Liquid viscosity, cP | 0.119 | 0.261 | 0.090 | 0.214 |

Case 1 Start of run—232 std. m$^3$/hr charge rate

| | |
|---|---|
| Wt % liquid - line 40 | 69.82 wt % |
| Wt % liquid - line 41 | 73.85 wt % |
| Wt % liquid - line 44 | 48.67 wt % |
| Phase Splitter PS1 ΔP (kg/cm$^2$) | 0.1358 |
| Liquid Velocity in bypass line, m/sec | 3.82 |
| Branch vapor line velocity, m/sec | 10.06 |

Case 2 Start of Run—99.4 std. m$^3$/hr charge rate—turndown

| | |
|---|---|
| Wt % liquid - line 40 | 67.79 wt % |
| Wt % liquid - line 41 | 69.65 wt % |
| Wt % liquid - line 44 | 58.06 wt % |
| Phase Splitter PS1 ΔP, kg/cm$^2$ | 0.0370 |
| Liquid Velocity in bypass line, m/sec | 1.98 |
| Branch vapor line velocity, m/sec | 7.22 |

Case 3 End of run—232 std. m$^3$/hr charge rate

| | |
|---|---|
| Wt % liquid - line 40 | 41.31 wt % |
| Wt % liquid - line 41 | 41.31 wt % |
| Wt % liquid - line 44 | 41.31 wt % |
| Phase Splitter PS1 ΔP, kg/cm$^2$ | 0.1102 |
| Liquid Velocity in bypass line, m/sec | 3.44 |
| Branch vapor line velocity, m/sec | 6.86 |

Case 4 End of run—99.4 std. m$^3$/hr charge rate—turndown

| | |
|---|---|
| Wt % liquid - line 40 | 43.33 wt % |
| Wt % liquid - line 41 | 41.80 wt % |
| Wt % liquid - line 44 | 51.34 wt % |
| Phase Splitter PS1 ΔP, kg/cm$^2$ | 0.0322 |
| Liquid Velocity in bypass line, m/sec | 1.84 |
| Branch vapor line velocity, m/sec | 5.39 |

While particular embodiments of the invention have been described, it will be understood that the invention is not limited thereto since many modifications may be made, and it is therefore contemplated to cover by the appended claims any such modifications as fall within the true spirit and scope of the invention.

What is claimed is:

1. A hydrotreating process for catalytically hydrogenating a hydrocarbon liquid, comprising the steps of:

preheating the hydrocarbon liquid in a single first indirect heat exchange means with a major portion of a mixed phase reactor effluent to produce a preheated hydrocarbon liquid, independently preheating a hydrogen containing vapor in a single second indirect heat exchange means with a minor portion of a mixed phase reactor effluent to produce a preheated hydrogen containing vapor, mixing the preheated hydrocarbon liquid with the preheated hydrogen containing vapor and heating to a reactor inlet temperature is a third indirect heat exchange means to produce a mixed phase hydrocarbon mixture, passing the mixed phase hydrocarbon mixture to a hydrogenation catalyst containing reactor vessel, thereby hydrogenating and heating to produce a mixed phase reactor effluent at a reactor outlet temperature, dividing the mixed phase reactor effluent by means of a two phase flow splitter thereby producing a major portion and a minor portion, both comprising about the same liquid/vapor volumetric ratio, passing said major portion to said first indirect heat exchange means and cooling by indirect heat exchange with said hydrocarbon liquid to produce a cooled major portion, independently passing said minor portion to said second indirect heat exchange means and cooling by indirect heat exchange with said hydrogen containing vapor to produce a cooled minor portion.

2. The process of claim 1 additionally comprising:

separating the cooled major portion and the cooled minor portion to yield the hydrogen containing vapor and a hydrotreated hydrocarbon liquid.

3. The process of claim 1 additionally comprising:

combining the cooled major portion and the cooled minor portion and separating to yield the hydrogen containing vapor and a hydrotreated hydrocarbon liquid.

4. A hydrotreating process for catalytically hydrogenating a hydrocarbon liquid, comprising the steps of:

passing a hydrocarbon liquid and a hydrogen containing gas to a hydrogenation catalyst containing reactor vessel, thereby hydrogenating and heating to produce a mixed phase reactor effluent at a reactor outlet temperature, dividing the mixed phase reactor effluent by means of a two phase flow splitter thereby producing a major portion and a minor portion, both comprising about the same liquid/vapor volumetric ratio, independently passing each of the portions to an indirect heat exchange means, to independently heat said hydrocarbon liquid and said hydrogen containing gas, thereby independently partially cooling said portions, and then combining and further cooling said portions to provide a fully cooled reactor effluent.

5. The process of claim 4, additionally comprising:

separating the cooled reactor effluent to yield the hydrogen containing vapor and a hydrotreated liquid.

6. A hydrotreating process for catalytically hydrogenating a hydrocarbon liquid, comprising the steps of:

preheating the hydrocarbon liquid in a single first indirect heat exchange means to produce a preheated hydrocarbon liquid, independently preheating a hydrogen containing vapor in a single second indirect heat exchange means to produce a preheated hydrogen containing vapor, mixing the preheated hydrocarbon liquid with the preheated hydrogen containing vapor and heating to a reactor inlet temperature is a third indirect heat exchange means to produce a mixed phase hydrocarbon mixture, passing the mixed phase hydrocarbon mixture to a hydrogenation catalyst containing reactor vessel, thereby hydrogenating and heating to produce a mixed phase reactor effluent at a reactor outlet temperature, dividing the mixed phase reactor effluent by means of a first two phase flow splitter thereby producing a major portion and a minor portion, both comprising about the same liquid/vapor volumetric ratio, passing said major portion to said first indirect heat exchange means and cooling by indirect heat exchange with said hydrocarbon liquid to produce a cooled major portion, independently passing said minor portion to said second indirect heat exchange means and cooling by indirect heat exchange with said hydrogen containing vapor to produce a cooled minor portion, combining the cooled major portion and cooled minor portion to form a second mixed phase reactor effluent and dividing by means of a second two phase flow splitter thereby producing a plurality of at least two second mixed phase portions, each of the second portions comprising about the same liquid/vapor ratio, independently cooling each of the second mixed phase portions by indirect heat exchange, combining the cooled second mixed phase portions and separating the combined cooled second mixed phase portions to yield the hydrogen containing vapor and a hydrotreated liquid.

7. The process of claim 6 wherein the plurality is 2 to 12 in number.

8. The process of claim 6 wherein the plurality is 4 to 8 in number.

* * * * *